United States Patent [19]

Greenwood

[11] 4,219,068

[45] Aug. 26, 1980

[54] DIE CASTING MACHINE

[75] Inventor: David Greenwood, Ilmington, near Shipston-on-Stour, England

[73] Assignee: Dynacast International Limited, Warwickshire, England

[21] Appl. No.: 43,625

[22] Filed: May 30, 1979

[51] Int. Cl.[3] ..... B22D 17/04

[52] U.S. Cl. ..... 164/316; 164/343; 425/593

[58] Field of Search ..... 164/316, 318, 312, 314, 164/341, 342, 343; 425/593, 451.6

[56] References Cited

U.S. PATENT DOCUMENTS

| | | | |
|---|---|---|---|
| 1,470,672 | 10/1923 | Ambrose | 164/316 |
| 2,004,959 | 6/1935 | Morin et al. | 164/316 X |
| 2,656,576 | 10/1953 | Schwartz | 164/318 X |
| 2,799,066 | 7/1957 | Federman et al. | 164/318 X |
| 3,319,702 | 5/1967 | Hartwig et al. | 164/316 |
| 3,364,981 | 1/1968 | Perrella et al. | 164/339 X |
| 3,495,652 | 2/1970 | Perrella | 164/342 X |
| 3,971,432 | 7/1976 | Hardey | 164/343 X |

FOREIGN PATENT DOCUMENTS

| | | | |
|---|---|---|---|
| 536111 | 5/1941 | United Kingdom | 164/314 |

*Primary Examiner*—Robert D. Baldwin
*Assistant Examiner*—J. Reed Batten, Jr.
*Attorney, Agent, or Firm*—Burgess, Ryan and Wayne

[57] ABSTRACT

A hot chamber pressure casting machine of the type having a gooseneck for drawing molten metal from a reservoir and injecting it into at least one die set movably mounted on a back plate. In one aspect of the invention, a track is provided on the back plate along which closure means for the die is adjustable. In another aspect of the invention, the back plate is in or near a vertical plane and the gooseneck nozzle has a passage, a major part of which lies in or near a horizontal plane when the nozzle is engaged with the die, and the end portion of the passage is inclined upwardly from the major part to the end.

57 Claims, 8 Drawing Figures

DIE CASTING MACHINE

BACKGROUND AND SUMMARY OF THE INVENTION

This invention relates to a hot chamber pressure die casting machine of the type comprising a reservoir for molten metal, a gooseneck, one end of which is adapted to be immersed in the molten metal and the other end of which provides a nozzle having an end surface adapted to be brought into engagement with a back surface of a die set from which a feed passage extends to a die cavity defined by the die set and into which a shot of molten metal is injected by a pump in the gooseneck, the die set being mounted on a back plate and comprising a plurality of dies movably mounted on the back plate between a closed position in which the die cavity is defined and an open position in which an article cast within the cavity can be ejected.

An object of the invention is to provide a new and improved die casting machine of the type described.

In one aspect of the present invention, there is provided a die casting machine of the type described wherein the back plate is provided with a track along which a die closure means is adjustable.

The machine may include a plurality of adjustable die closure means and the track may comprise a single circular track lying in the plane of the back plate.

Hitherto, a separate back plate for each die set to be used with the machine has been required, or, the back plate has been provided with a predetermined number of locations at which the dies of a limited number of die sets can be located. Thus, it has not been convenient to change the die sets where different numbers of dies and or different directions of movement of the dies have been required. The present invention overcomes these problems since one, more than one, or all, of the die closure means may be made adjustable along a track of the desired extent and preferably all the die closure means are mounted on a continuous circular track so that they can be oriented in any desired angular position around the back plate.

Preferably, the die closure means is operable to reciprocate the die between the open and closed positions by a linkage from a drive means, the axes of pivot of the linkage lying in a plane parallel to the plane of the back plate and the drive means may comprise a fluid operated piston and cylinder device.

By providing that the linkage and drive means of the die closure means are oriented in this fashion, the area covered by these means in the plane of the back plate is minimized thus permitting closer proximity between adjacent die closure means than has hitherto been possible since conventionally, the axes of the linkage have been in a plane normal to the plane of the back-plate.

As a result, a core member for the die set may be provided with a closure means between one or more pairs of dies.

Clamping means may be provided to permit securing the die closure means in a desired position along the track.

Although a single continuous circular track is preferred, if desired, separate tracks may be provided for each or for only one or more than one of the closure means and the tracks may extend in any desired direction.

Although in the preferred embodiment the back plate lies in a vertical plane, this aspect of the present invention may be applied to a die casting machine in which the back plate does not lie in a vertical plane.

In order to facilitate ejection of a cast article on the die set when the dies are in their open position, it is desired that the back plate should lie in or near (i.e., within 25° and preferably within 10° or 5° of) a vertical plane. However, it was found that if a vertical or near vertical back plate is used, which results in the back surface of the dies from which the feed passage extends also lying in or near a vertical plane, with a gooseneck having a nozzle in which the passage for metal, adjacent the die set engaging end surface, extends in or near a horizontal plane, then metal tends to run out of the nozzle passage at the end surface when the end surface is moved out of engagement with the die set.

It is accordingly another object of the invention to provide a die casting machine of the type described from which cast articles can be easily ejected and in which the above-mentioned problem of "metal dribble" is overcome or is reduced.

According to a second aspect of the invention, there is provided a die casting machine of the type described wherein the back plate lies in or near a vertical plane and the gooseneck nozzle has a passage, part of which lies in or near a horizontal plane, when the nozzle end surface is engaged with the back surface of the die set, and an end portion which is inclined upwardly from the major part to the end surface of the nozzle.

This arrangement avoids metal dribbling out of the nozzle when the nozzle end surface is moved out of engagement with the back surface of the die set and also permits the provision of nozzle heating means including a conventional electrical heating jacket which is relatively bulky and which could not be provided if the whole of the nozzle were to be inclined upwardly.

BRIEF DESCRIPTION OF THE DRAWINGS

The preferred embodiments of the invention will now be described in more detail by way of example with reference to the accompanying drawings wherein.

DESCRIPTION OF THE PREFERRED EMBODIMENTS

Figure 1:
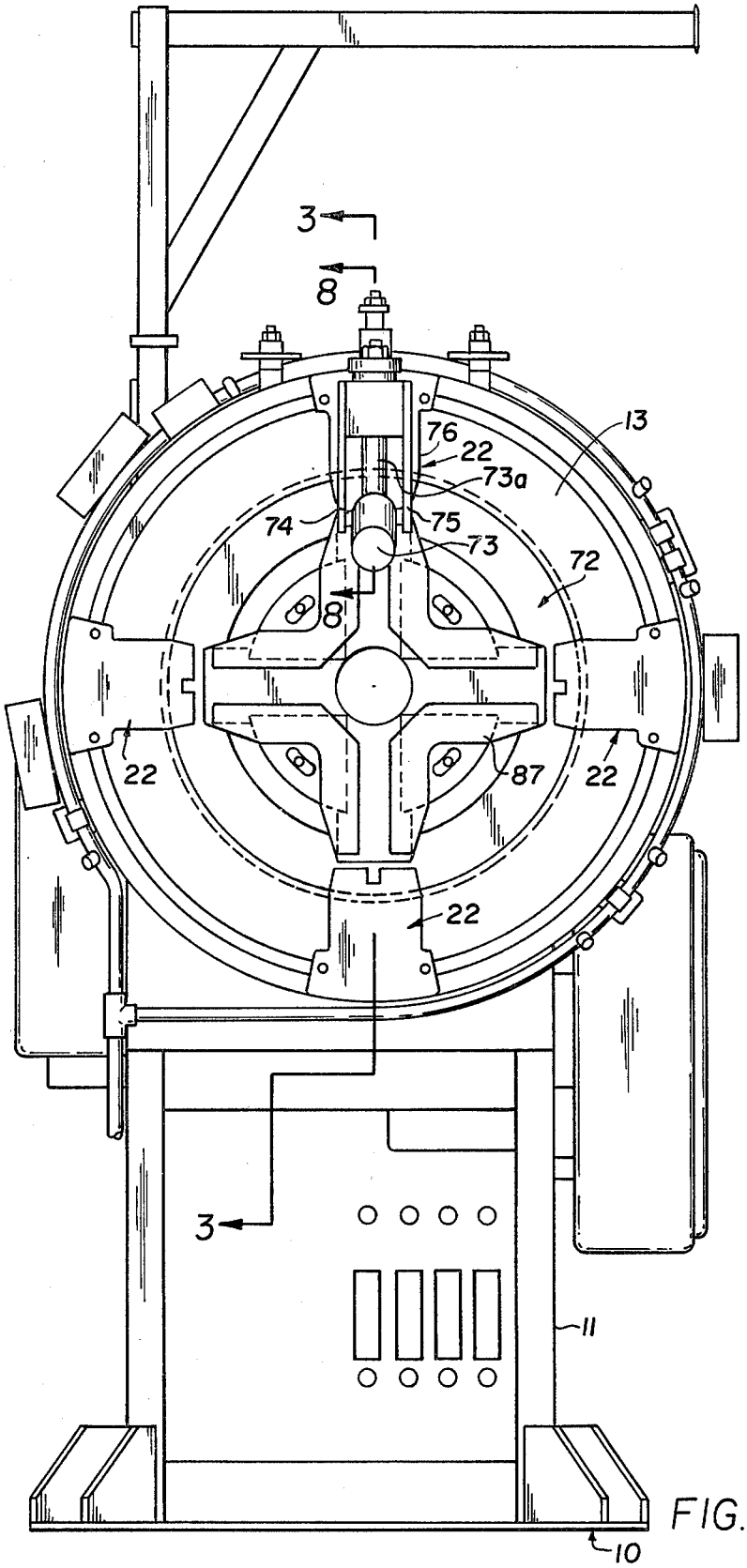
FIG. 1 is a front elevation of a die casting machine embodying the invention.

Referring to the drawings, a die casting machine for producing pressure die castings of zinc is illustrated generally at 10 and comprises a base part 11 which carries a crucible 12 which in use contains molten zinc and thus provides a reservoir for the zinc. The base part 11 also carries a circular back plate 13 having a central opening 14 through which a nozzle 15 of a gooseneck 16 projects so that an end surface 17 of the nozzle 15 can be engaged with a back surface 18 of a die set indicated generally at 19 in FIG. 5 so as to be in metal transmitting relationship with a feed passage 20 which extends from the back surface 18 to a cavity defined by the die set. In the example illustrated, the back plate lies in a vertical plane but may lie in other planes. For example, the second aspect of the invention can be practiced when the back plate is inclined to the vertical at up to 25°.

The die set 19 comprises four dies mounted in die carriers 21 mounted on the back plate 13 so as to be slidable in the plane of the back plate at 90° to each other by means of die closing means indicated generally at 22. If desired, the dies may be slidable in directions other than 90°.

Figure 3:
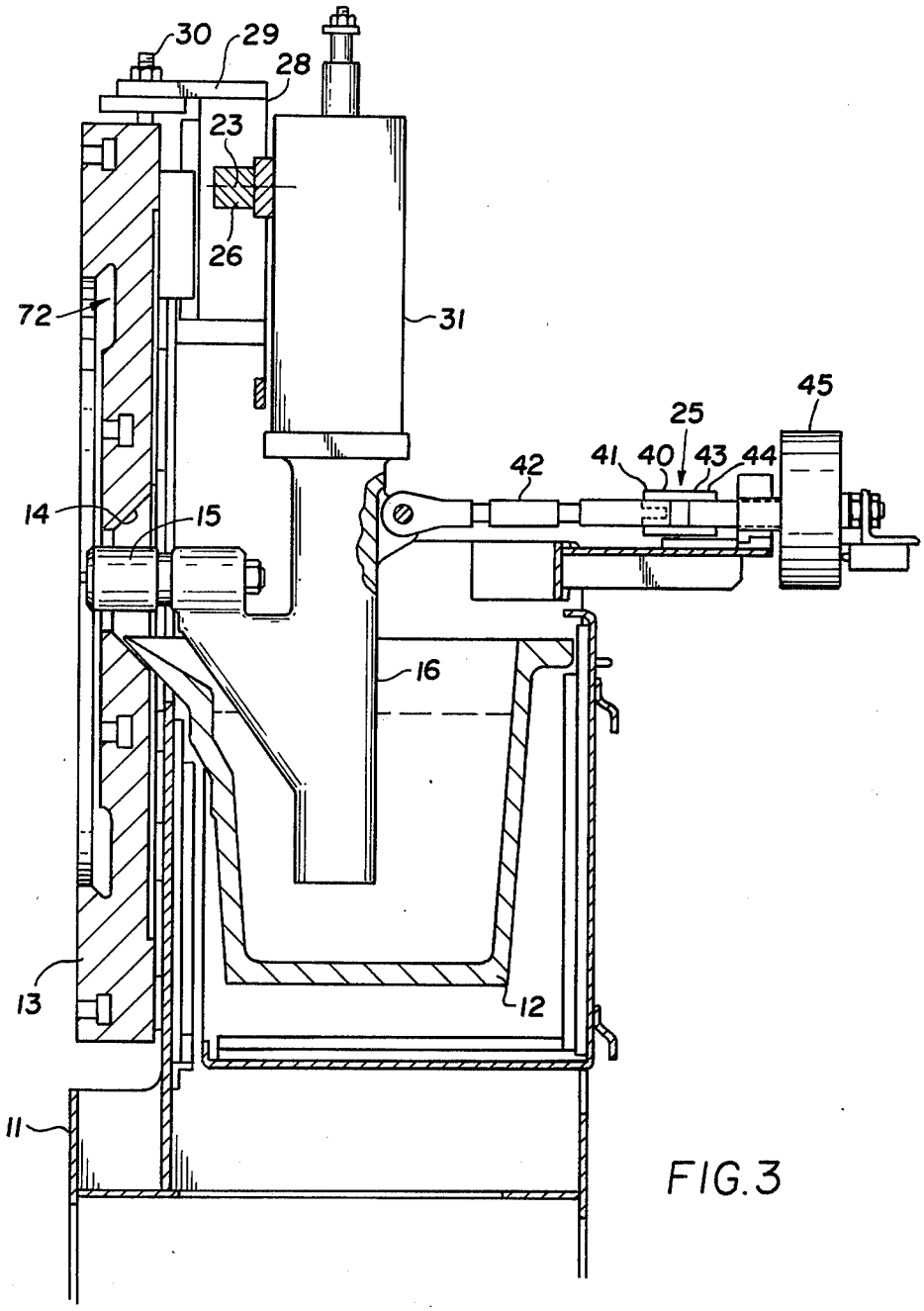
FIG. 3 is a section on the line 3—3 of FIG. 1.

Referring now particularly to FIG. 3, the gooseneck 16 is mounted for pivotal movement about an axis 23 so as to move the end surface 17 of the gooseneck nozzle 15 into and out of engagement with the back surface 18 of the die set. This movement is caused by a drive means 38 connected to the gooseneck through a toggle mechanism 25.

The gooseneck 16 is mounted on the base part 11 by means of an axle member 26 having end bearing portions which are received in bearing apertures 27 formed in brackets 28 connected to arms 29 which are themselves carried at the upper ends of threaded rods 30. The rods 30 are mounted on the back plate 13 and the arrangement is such that rotation of a rod permits vertical adjustment of the bracket 28 connected thereto and thereby permits adjustment of the position of the end surface 17 of the nozzle 15 relative to the back surface 18 of the die set.

Figure 5:
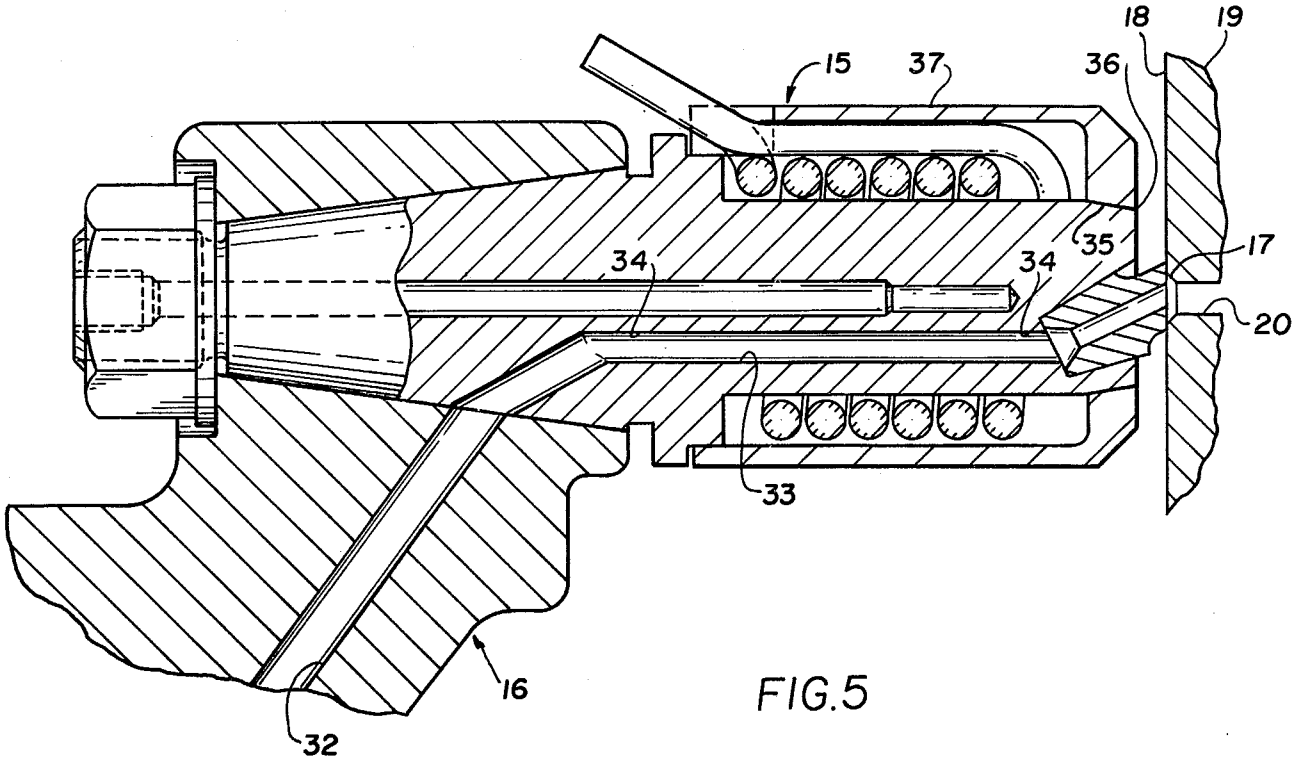
FIG. 5 is a fragmentary longitudinal cross-sectional view, to an enlarged scale, through the gooseneck nozzle of the machine of FIG. 1.

The gooseneck 16 contains a conventional pump in housing arrangement 31 whereby molten zinc contained within the crucible 12 is drawn from the crucible into the interior of the gooseneck and is then injected in the die cavity through the feed passage 20 by means of an internal passage 32 formed in the gooseneck and a passage 33 formed in the nozzle 15. The major length of the passage 33 in the gooseneck i.e., the part indicated at 34 extends in a horizontal direction when the end surface 17 and back surface 18 are in engagement as shown in FIG. 5. A minor part 35 of the passage extends from the outer end of the major part 34 to the end surface 17 in a direction which is inclined upwardly from the part 34 to the end surface 17 at an angle of 25°. When the back plate is inclined to the vertical, the major part 34 may also be inclined to the horizontal, for example, by an angle equal to the inclination of the back plate to the vertical.

This is done to avoid molten zinc dribbling from the end surface 17 when the gooseneck is withdrawn out of contact with the back surface 18 which could otherwise be the case. The arrangement is such that the injection pump closes the passage 32 before the nozzle is withdrawn from the back of the die thereby preventing metal drawing back, and keeping the part 35 of the passage 33 full of molten metal. This is nevertheless below the bottom of the aperture in the end surface 17.

By providing that the major part 34 of the passage 33 extends in a horizontal direction, then the general extent of the nozzle can also lie horizontally and the end surface 36 can lie in a vertical plane thereby permitting the fitting of a conventional electrical heating jacket 37 to the nozzle without interference with the die set 19 or back plate 13.

It will be appreciated that the precise angle of the minor part 35 and the relative extent of the parts 34 and 35 may be varied from that described hereinbefore whilst still achieving the objects described hereinbefore.

Figure 4:
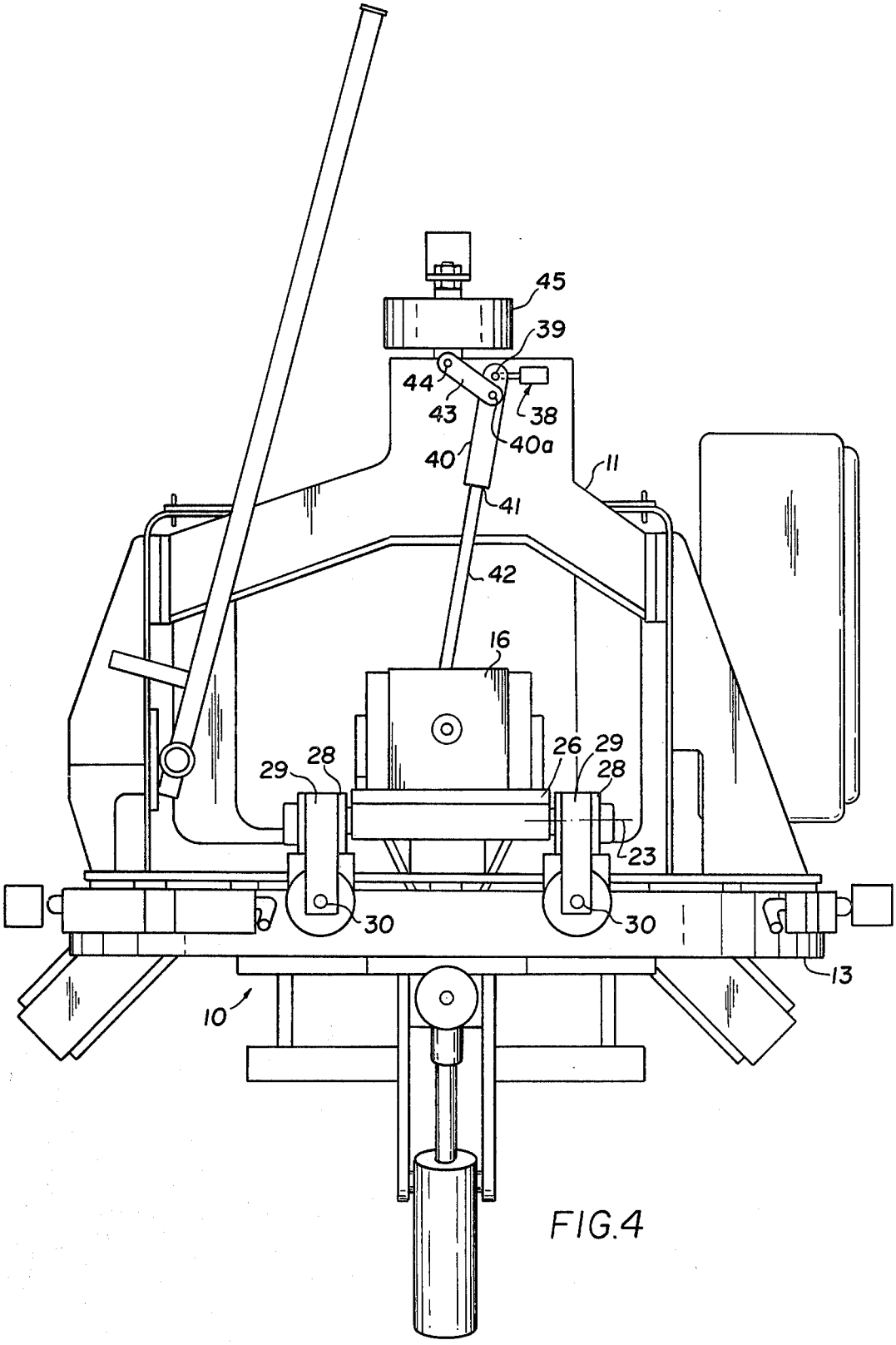
FIG. 4 is a plan view of the machine of FIG. 1.

Referring to FIGS. 3 and 4, the gooseneck 16 is pivoted into and out of engagement with the die set about the axis 23 by means of a pneumatic piston and cylinder device 38, the cylinder of which is connected to the base part 11 of the apparatus whilst the piston rod of which is pivotally connected, at 39, to a toggle mechanism 25 which comprises a first link 40 one end of which is rigidly connected, at 41, to a rod 42 connected to the gooseneck 16 whilst the other end is connected to the piston rod at 39 and a pair of second links 43 one end of which are pivotally connected at 44 to the base part 11 of the apparatus through an air spring 45 and the other ends of which are connected to the first link 40 at **40*a***.

Figure 6:
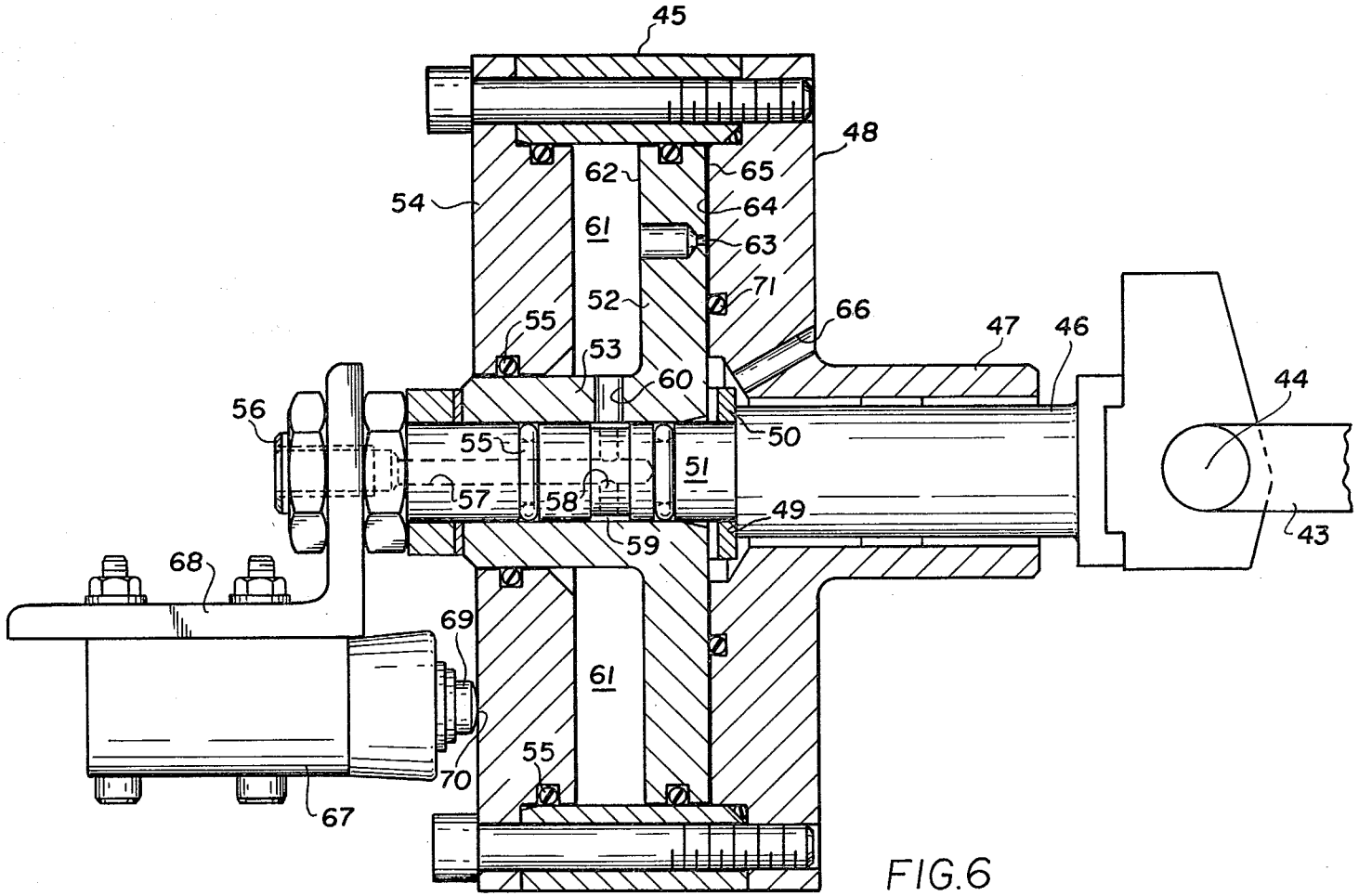
FIG. 6 is a fragmentary longitudinal cross-sectional view, to an enlarged scale, through the gooseneck closure means of the machine of FIG. 1.
Figure 7:
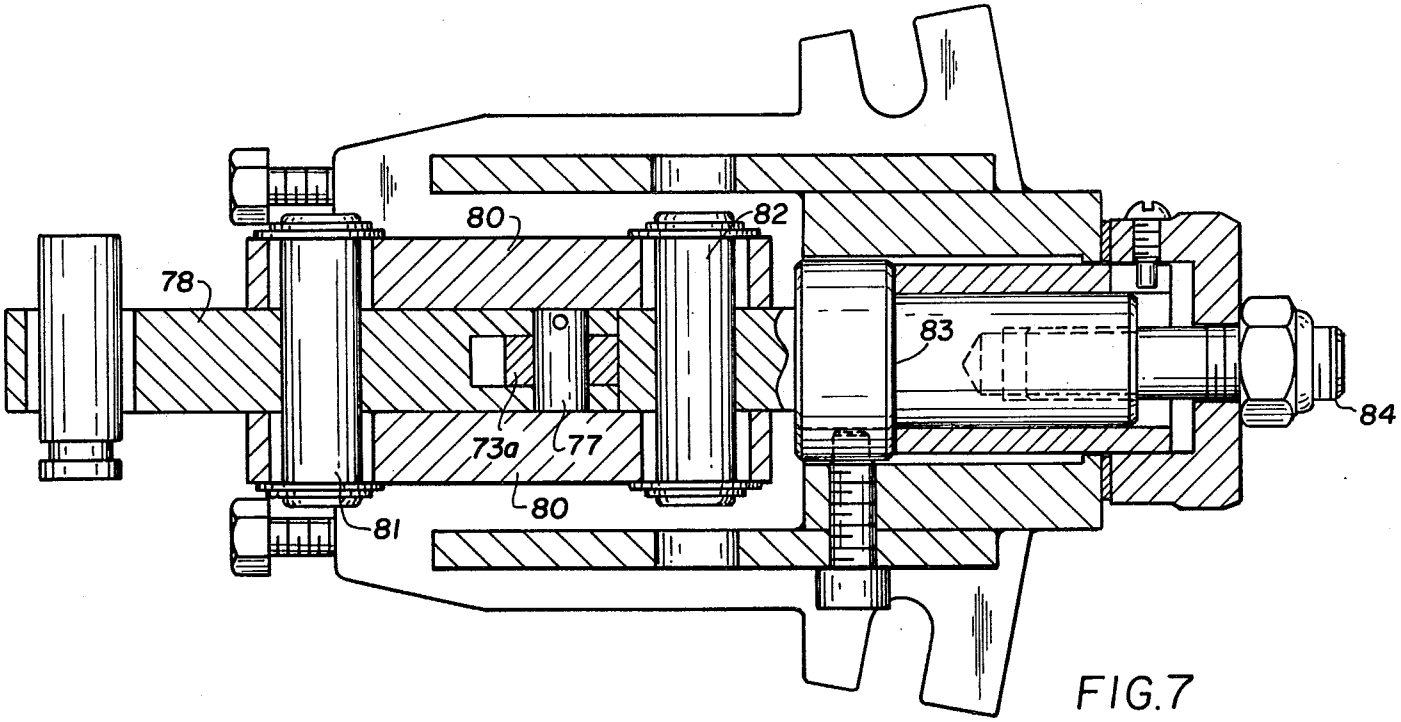
FIG. 7 is a section on the line 7—7 of FIG. 2.
Figure 8:
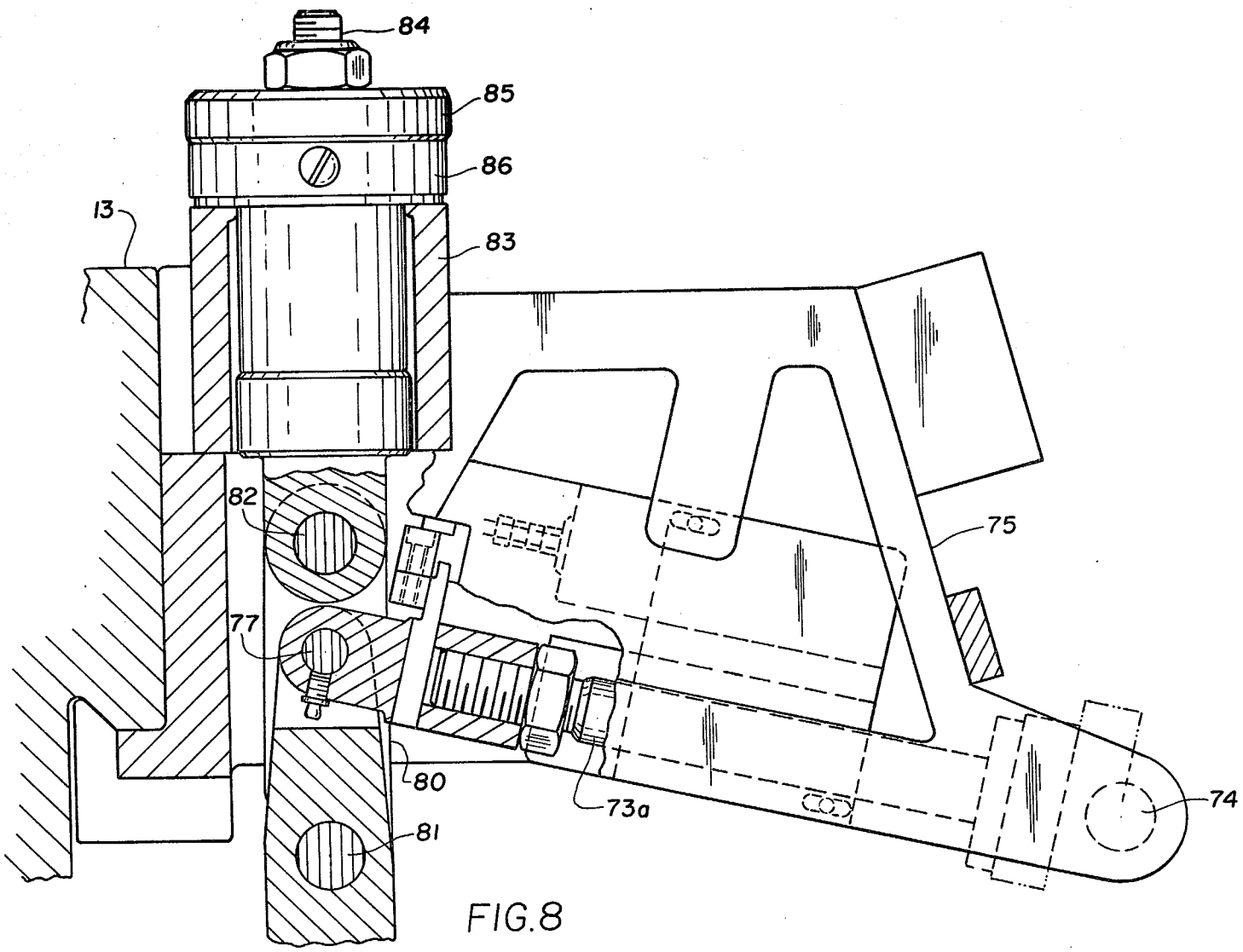
FIG. 8 is a section on the line 8—8 of FIG. 1.

Referring now particularly to FIG. 6, the links 43 are connected, at 44 to a piston rod 46 of the air spring 45 which extends through a nose part 47 of the cylinder 48 of the air spring. The piston rod 46 has a shoulder 49 with which a washer 50 is engaged. Rotatably mounted on a reduced diameter part 51 of the piston rod 46 is a piston 52 having a boss 53 apertured to receive the part 51 and extending through a rear wall 54 of the cylinder 48. Conventional O-ring seals 55 are provided between the wall 54 and the boss 53 and between the wall of the passage in the boss 53 and the reduced diameter part 51. Air under pressure is fed via a connector 56, axial passage 57, radial passages 58 and circumferential groove 59 in the part 51 of the piston rod 46 and a radial passage 60 in the boss 53 to the region 61 so as to act on one side 62 of the piston 52 and via a bleed aperture 63, to act on a reduced area part 64 of the other side 65 of the piston 52.

An exhaust passage 66 extends from the interior of the cylinder 48 adjacent the washer 50 to the atmosphere. A microswitch 67 is mounted on a bracket 68 fixed to the end of the piston rod 46 and the operating member 69 of which is adapted to engage a surface 70 of the cylinder 48.

In use, when it is desired to move the end surface 17 of the gooseneck nozzle 15 into metal transferring relationship with the back surface 18 of the die set 19, the pneumatic piston and cylinder device 38 is actuated to move the piston rod thereof outwardly of the cylinder so as to tend to move the links 40 and 43 into axial alignment thereby moving the rod 42 to the left in FIG. 3 and thus pivoting the gooseneck 16 about the axis 23. When the end surface 17 engages the back surface 18 so that the movement of the gooseneck 16 is prevented, then, whilst movement of the piston rod of the device 38 continues, this causes only movement of the piston rod 46 of the air spring 45 to the left in FIG. 6 thus engaging the washer 50 with the piston 52 to move the piston 52 to the left. This has two effects. One effect is that the air acting on the reduced cross-sectional area 64 of the piston 52 is permitted to move past an O-ring seal 71 and hence be exhausted to the atmosphere through the exhaust passage 66. As a result, the whole of the side 65 of the piston will be subjected to only atmospheric pressure whilst the whole of the side 62 will be subjected to air under pressure fed via the connector 56 and passages 57, 58, groove 59 and passage 60. As a result, whilst the piston and cylinder device 38 is permitted to carry out its full stroke since the piston 52 can move to the left against the pressure of the air acting in the region 61, the force exerted by the drive means on the gooseneck is increased, once contact between the surfaces 17 and 18 has taken place, due to the air acting on the piston 52 as described hereinbefore and also the pressure pressing the surfaces 17 and 18 into contact can be maintained constant irrespective of any variation in the dimensions between the gooseneck and the connection of the toggle mechanism to the base part 11 since the pressure is determined by the force exerted by the air on the piston 52.

The second thing which happens is that to cause the plunger 69 to operate the micro-switch so that it sends a signal to a control mechanism of the machine to permit the pump in the gooseneck to operate to feed a shot of metal since movement of the piston rod 46 to the left will have meant that the surfaces 17 and 18 are in metal transferring relationship.

Figure 2:
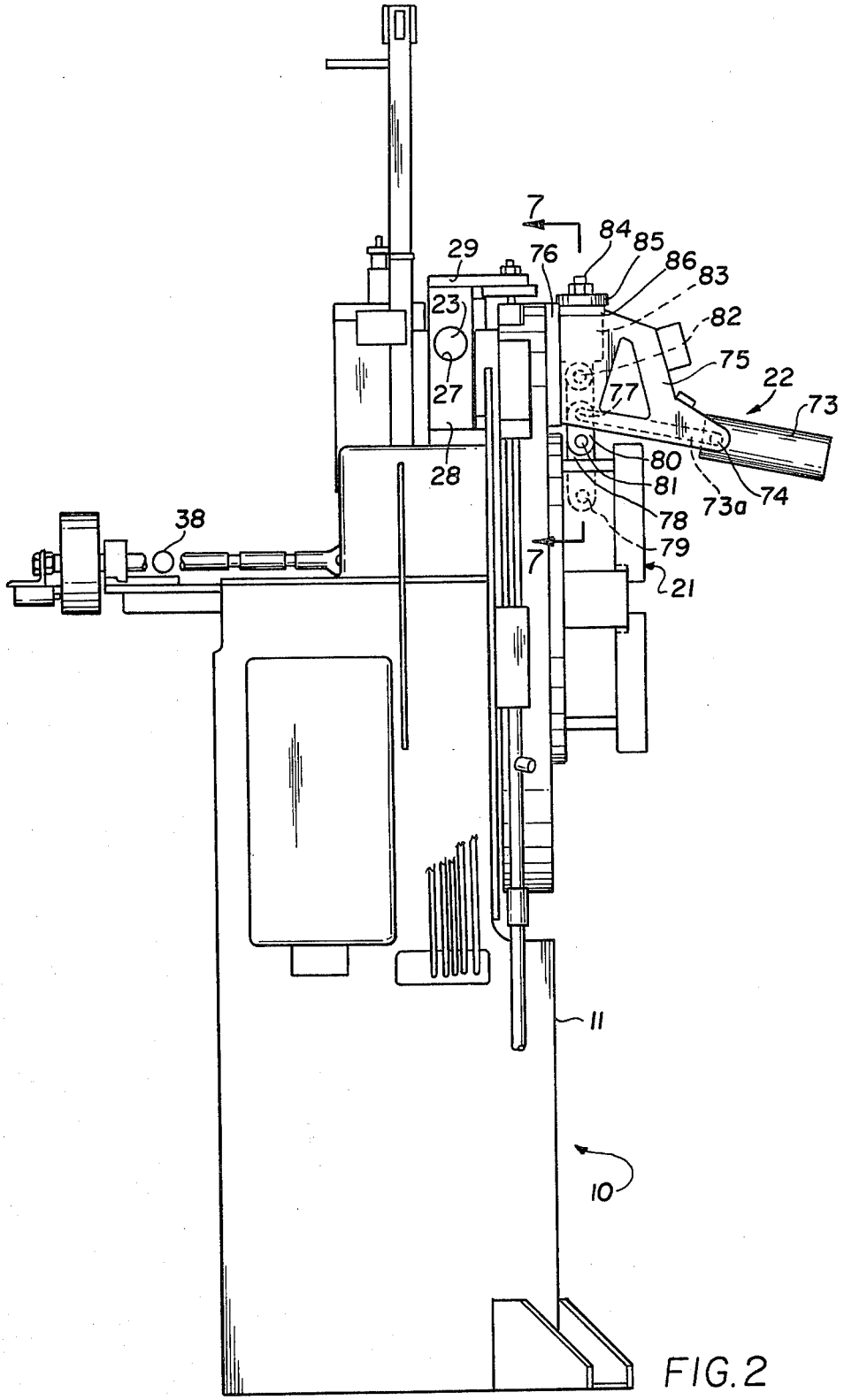
FIG. 2 is a side elevation of the machine of FIG. 1 looking from the left of FIG. 1.

As best shown in FIGS. 1 and 3, the back plate 13 is provided with a continuous circular track 72 the center of the track being the center of the opening of the passage part 35 in the end surface 17. Mounted in the track 72 are four die closure means 22. In FIGS. 1 and 2, only one closure means is shown in its entirety, the other three being shown schematically but they are, in fact, identical to that shown in detail. Each die closure means comprises a pneumatic piston and cylinder device 73 pivotally mounted at 74 on a bracket 75 fixed to a shoe 76 engaged with the track 72 and provided with means such as clamping bolts to clamp it in a desired position circumferentially of the track. The piston rod 73*a* of the device 73 is pivotally connected at 77 to one end of a first link 78 of a toggle mechanism, the other end of the link 78 being connected at 79 to a die. A pair of second links 80 are connected at 81, intermediate the points 77 and 79, to the first link 78 and at 82 to an adjustment member 83 having a threaded rod 84 in threaded engagement with an adjustment member 85 which abuts the end of a housing 86 so that rotation of the member 85 moves the rod 84 axially and hence the pivot 82 so that the closure position of the die can be adjusted.

The dies are mounted for sliding movement in a cross head 87. It will be appreciated that the position of the die closure means can be easily and conveniently adjusted to suit any particular die head which is clamped to the backing plate in a conventional manner merely by moving the shoes 76 circumferentially of the track to the desired position. Also, if desired, additional closure means may be provided intermediate the four described hereinbefore; also a closure means may be provided for one or more core members which may be required with any particular die set.

If desired, the track or tracks can be provided on a member separate from the remainder of the back plate and fixed thereto.

What is claimed is:

1. In a pressure die casting machine comprising a back plate, a reservoir for molten metal, at least one gooseneck, one end of which is adapted to be immersed in the molten metal and the other end of which terminates in a nozzle having an end surface adapted to be brought into engagement with a back surface of a die set from which a feed passage extends to a die cavity defined by the die set, said gooseneck further having a passage communicating said one end with said other end and pump means for drawing molten metal into said gooseneck through said one end and injecting same from said gooseneck through said other end, said die set being movably mounted on said back plate between a closed position in which the die cavity is defined and an open position in which an article cast within the cavity can be ejected, the improvement comprising adjustable closure means for said die, and a track on said back plate, said closure means being adjustable along said track.

2. A machine according to claim 1, further comprising a plurality of adjustable die closure means.

3. A machine according to claim 1, wherein the track comprises a single circular track lying in the plane of the back plate.

4. A machine according to claim 1, wherein a plurality of separate tracks are provided there being at least one closure means associated with each track.

5. A machine according to claim 1, where the adjustable die closure means is operable to reciprocate the dies between the open and the closed positions by a linkage from a drive means.

6. A machine according to claim 5, wherein the axes of pivot of the linkage lie in a plane parallel to the plane of the back plate.

7. A machine according to claim 5, wherein the drive means comprises a fluid operated piston and cylinder means.

8. A machine according to claim 6, wherein the linkage is a toggle linkage.

9. A machine according to claim 1, wherein clamping means are provided to secure each die closure means in a desired position along its associated track.

10. A machine according to claim 1, wherein the track is integral with the back plate.

11. A machine according to claim 1, wherein the track is separate from the remainder of the back plate and is secured thereto.

12. A die casting machine according to claim 1, wherein the gooseneck is moved, to engage the end surface of the nozzle thereof with the back surface of the die set, by mean of a toggle mechanism.

13. A machine according to claim 12, wherein the toggle mechanism is anchored to a fixed part of the machine through a biasing means.

14. A machine according to claim 13, wherein the biasing means is a resilient biasing means.

15. A machine according to claim 14, wherein the resilient biasing means comprises an air spring.

16. A machine according to claim 15, wherein the air spring applies an increased force to the gooseneck once the end surface thereof has engaged the back surface of the die set.

17. A machine according to claim 13, wherein the toggle mechanism comprises a first link pivotally connected at one end to the gooseneck and a second link pivotally connected at one end to a fixed part of the machine, said links when the end and back surfaces are in engagement extending generally parallel to the direction of movement of the gooseneck and being generally axially aligned and drive means being connected to the other ends of the links to cause pivotal movement thereof in a direction transverse to the direction of movement of the gooseneck to move the end surface out of engagement with the back surface.

18. A machine according to claim 17, wherein the drive means comprises a fluid operated piston and cylinder device.

19. A machine according to claim 18, wherein the piston has a piston rod which extends transversely to said direction of movement.

20. A machine according to claim 19, wherein the piston rod has a head to which the other ends of said links are pivotally connected.

21. A machine according to claim 13, wherein means are provided to sense engagement between the end and back surfaces and to permit operation of the pump of the gooseneck only subsequent to such engagement.

22. A machine according to claim 21, wherein said sensing is achieved by sensing movement of the biasing means.

23. A machine according to claim 16, wherein the air spring comprises a cylinder, a piston movable in the cylinder, the piston being connected to one end of the toggle mechanism, means to supply air under pressure to act on one side of the piston and restricted passage means to permit said air to act on a smaller cross-sectional area of the other side of the piston when the piston is in a first position wherein said end and back surfaces are not in engagement and exhaust means to connect said other side of the piston to the atmosphere and valve means operated when the end and back surfaces are moved into engagement to connect said exhaust means to the other side of the piston.

24. In a pressure die casting machine comprising a back plate, a reservoir for molten metal, at least one gooseneck, one end of which is adapted to be immersed in the molten metal and the other end of which terminates in a nozzle having an end surface adapted to be brought into engagement with a back surface of a die set from which a feed passage extends to a die cavity defined by the die set, said gooseneck further having a passage communicating said one end with said other end and pump means for drawing molten metal into said gooseneck through said one end and injecting same from said gooseneck through said other end, said die set being movably mounted on said back plate between a closed position in which the die cavity is defined and an open position in which an article cast within the cavity can be ejected, the improvement comprising means for disposing the back plate in or near a vertical plane, the gooseneck nozzle having a passage therein, means for positioning said nozzle so that a part of said passage lies in or near a horizontal plane, when the nozzle end surface is engaged with the back surface of the die set, and an end portion of said passage is inclined upwardly from the major part to the end surface of the nozzle.

25. A machine according to claim 24, wherein the back plate lies in a vertical plane.

26. A machine according to claim 25, wherein said part of the passage is horizontal.

27. A machine according to claim 26, wherein said part of the passage comprises a major part of the length thereof.

28. A machine according to claim 24, wherein the nozzle is provided with a heating means.

29. A machine according to claim 28, wherein the heating means comprises an electrical heating coil surrounding an end part of the nozzle adjacent the die set.

30. A machine according to claim 24, wherein the end portion is inclined to said part of the passage at an angle of 25°.

31. A machine according to claim 24, wherein, in use, on withdrawal of the nozzle from the die set, the level of molten metal in the nozzle passage is above the top of said part and below the bottom of the aperture formed in the end surface where said end portion intersects the nozzle end surface.

32. A machine according to claim 24, wherein the external configuration of the nozzle at least adjacent the die set is generally cylindrical and the end surface of said part of the nozzle extends parallel to the back plate.

33. A machine according to claim 24 wherein said end portion is formed in an insert removably engageable with the remainder of the nozzle.

34. A machine according to claim 24, wherein the end surface of the nozzle which engages the back surface of the die set lies in a vertical plane when in engagement with the back surface.

35. A die casting machine according to claim 24, wherein the gooseneck is moved, to engage the end surface of the nozzle thereof with the back surface of the die set, by means of a toggle mechanism.

36. A machine according to claim 35, wherein the toggle mechanism is anchored to a fixed part of the machine through a biasing means.

37. A machine according to claim 36, wherein the biasing means is a resilient biasing means.

38. A machine according to claim 37, wherein the resilient biasing means comprises an air spring.

39. A machine according to claim 38, wherein the air spring applies an increased force to the gooseneck once the end surface thereof has engaged the back surface of the die set.

40. A machine according to claim 36, wherein the toggle mechanism comprises a first link connected at one end to the gooseneck and at the other end to a drive means and a second link pivotally connected at one end to a fixed part of the machine and at the other end to the first link adjacent to said connection to the drive means, said links when the end and back surfaces are in engagement extending generally parallel to the direction of movement of the gooseneck and being generally axially aligned and said drive means being operative to cause pivotal movement thereof in a direction transverse to the direction of movement of the gooseneck to move the end surface out of engagement with the back surface.

41. A machine according to claim 40, wherein the drive means comprises a fluid operated piston and cylinder device.

42. A machine according to claim 41, wherein the piston has a piston rod which extends transversely to said direction of movement.

43. A machine according to claim 42, wherein the piston rod has a head to which said other end of said first link is pivotally connected.

44. A machine according to claim 36, wherein means are provided to sense engagement between the end and back surfaces and to permit operation of the pump of the gooseneck only subsequent to such engagement.

45. A machine according to claim 44, wherein said sensing is achieved by sensing movement of the biasing means.

46. A machine according to claim 41, wherein the air spring comprises a cylinder, a piston movable in the cylinder, the piston being connected to one end of the toggle mechanism, means to supply air under pressure to act on one side of the piston and restricted passage means to permit said air to act on a smaller cross-sectional area of the other side of the piston when the piston is in a first position wherein said end and back surfaces are not in engagement and exhaust means to connect said other side of the piston to the atmosphere and valve means operated when the end and back surfaces are moved into engagement to connect said exhaust means to the other side of the piston.

47. A die casting machine according to claim 24, further comprising adjustable closure means for said die and, wherein the back plate is provided with a track, said closure means being adjustable along said track.

48. A machine according to claim 47, wherein the machine includes a plurality of adjustable die closure means.

49. A machine according to claim 48, wherein the track comprises a single circular track lying in the plane of the back plate.

50. A machine according to claim 48, wherein a plurality of separate tracks are provided there being at least one closure means associated with each track.

51. A machine according to claim 47, wherein the adjustable die closure means is operable to reciprocate the dies between the open and the closed positions by a linkage from a drive means.

52. A machine according to claim 51, wherein the axes of pivot of the linkage lie in a plane parallel to the plane of the back plate.

53. A machine according to claim 51, wherein the drive means comprises a fluid operated piston and cylinder device.

54. A machine according to claim 52 wherein the linkage is a toggle linkage.

55. A machine according to claim 47, wherein clamping means are provided to secure the die closure means in a desired position along its associated track.

56. A machine according to claim 47, wherein the track is integral with the back plate.

57. A machine according to claim 47, wherein the track is separate from the remainder of the back plate and is secured thereto.

* * * * *